US009827461B1

(12) United States Patent
Miller

(10) Patent No.: US 9,827,461 B1
(45) Date of Patent: Nov. 28, 2017

(54) ELLIPTICAL EXERCISE DEVICE

(71) Applicant: Larry D. Miller Trust, Rochester, MI (US)

(72) Inventor: Larry D. Miller, Rochester, MI (US)

(73) Assignee: Larry D. Miller Trust, Rochester, MI (US)

( * ) Notice: Subject to any disclaimer, the term of this patent is extended or adjusted under 35 U.S.C. 154(b) by 0 days.

(21) Appl. No.: 15/492,673

(22) Filed: Apr. 20, 2017

Related U.S. Application Data

(60) Provisional application No. 62/477,275, filed on Mar. 27, 2017.

(51) Int. Cl.
*A63B 21/00* (2006.01)
*A63B 21/22* (2006.01)
*A63B 22/06* (2006.01)

(52) U.S. Cl.
CPC ..... *A63B 22/0664* (2013.01); *A63B 21/154* (2013.01); *A63B 21/225* (2013.01); (Continued)

(58) Field of Classification Search
CPC ..... A63B 21/00058; A63B 21/00061; A63B 21/00065; A63B 21/00069; A63B 21/00072; A63B 21/00185; A63B 21/068; A63B 21/08; A63B 21/15; A63B 21/151; A63B 21/152; A63B 21/154; A63B 21/159; A63B 21/22; A63B 21/225; A63B 21/4027; A63B 21/4033; A63B 21/4034; A63B 21/4035; A63B 21/4045; A63B 21/4047; A63B 21/4049; A63B 22/0002; A63B 22/001; A63B 22/0015; A63B 22/0017; A63B 22/0046; A63B 22/0048; A63B 22/0056; A63B 22/06; A63B 22/0664; A63B 22/0694; A63B 2022/0051; A63B 2022/0053; A63B 2022/0092; A63B 2022/067; A63B 2022/0676; A63B 2022/0682; A63B 2023/003; A63B 2023/0441; A63B 2023/0452; A63B 23/02; A63B 23/0205; A63B 23/0216; A63B 23/0222; A63B 23/035; A63B 23/03516; A63B 23/03533; A63B 23/03575; A63B 23/04; A63B 23/0405; A63B 23/0423; A63B 23/0429; A63B 23/0482; A63B 23/0494; A63B 23/12; A63B 23/1209; A63B 23/1245; A63B 23/1263; A63B 23/1281; A63B 26/003; A63B 2026/006; (Continued)

(56) References Cited

U.S. PATENT DOCUMENTS 5,242,343 A * 9/1993 Miller ..... A63B 21/015 482/51
5,518,473 A 5/1996 Miller
(Continued)

*Primary Examiner* — Andrew S Lo
*Assistant Examiner* — Gary D Urbiel Goldner
(74) *Attorney, Agent, or Firm* — Dinsmore & Shohl LLP

(57) ABSTRACT

An exercise device has a frame supporting guide links to which foot support links are pivotally attached. Upper pulleys are pivotally connected to the frame. Lower pulleys are connected to the foot support links. A vertical drive assembly is coupled to the foot support links by flexible elements. The flexible elements extend from the vertical drive assembly, about an upper pulley, about a lower pulley and to a second end connected to the frame.

30 Claims, 2 Drawing Sheets

(52) U.S. Cl.
CPC ..... *A63B 21/4034* (2015.10); *A63B 21/4035* (2015.10); *A63B 2022/0676* (2013.01)

(58) Field of Classification Search
CPC . A63B 69/0028; A63B 69/0035; A63B 69/18; A63B 69/182; A63B 2069/0031; A63B 2069/0033; A63B 2208/02; A63B 2208/0204; A63B 2225/09; A63B 2225/093; A63B 2244/19
See application file for complete search history.

(56) References Cited

U.S. PATENT DOCUMENTS 5,611,756 A 3/1997 Miller
5,755,645 A * 5/1998 Miller ..... A61H 1/0285 482/115
5,967,944 A * 10/1999 Vittone ..... A63B 22/001 482/37
6,042,510 A * 3/2000 Miller ..... A63B 22/001 482/51
6,045,487 A 4/2000 Miller
7,556,591 B2 7/2009 Chuang et al.
7,708,668 B2 5/2010 Rodgers, Jr.
8,979,714 B2 3/2015 Miller
9,061,175 B1 * 6/2015 Miller ..... A63B 22/0664
9,072,936 B1 * 7/2015 Miller ..... A63B 22/0664
9,144,706 B1 * 9/2015 Maresh ..... A63B 22/04
9,192,809 B1 * 11/2015 Miller ..... A63B 21/154
9,192,811 B1 * 11/2015 Miller ..... A63B 22/0664
9,498,672 B1 * 11/2016 Miller ..... A63B 22/0664
9,511,253 B1 * 12/2016 Miller ..... A63B 22/001
9,649,529 B1 * 5/2017 Miller ..... A63B 22/0664
2004/0266587 A1 * 12/2004 Miller ..... A63B 22/0664 482/52
2007/0219061 A1 * 9/2007 Rodgers, Jr. ..... A63B 21/151 482/52
2008/0248928 A1 * 10/2008 Chu ..... A63B 22/001 482/52
2009/0105049 A1 * 4/2009 Miller ..... A63B 22/0017 482/52
2013/0210578 A1 * 8/2013 Birrell ..... A63B 71/0622 482/4
2013/0231217 A1 * 9/2013 Miller ..... A63B 22/001 482/52
2014/0051552 A1 * 2/2014 Habing ..... A63B 21/154 482/52
2014/0296036 A1 * 10/2014 Miller ..... A63B 22/001 482/52
2014/0336006 A1 * 11/2014 Miller ..... A63B 21/154 482/52
2014/0336007 A1 * 11/2014 Miller ..... A63B 22/04 482/52
2015/0306451 A1 * 10/2015 Arnold ..... A63B 22/0015 482/4
2015/0335943 A1 * 11/2015 Miller ..... A63B 22/0664 482/52
2016/0001124 A1 * 1/2016 Huang ..... A63B 21/151 482/52
2016/0059067 A1 * 3/2016 Miller ..... A63B 21/154 482/52
2016/0151659 A1 * 6/2016 Arnold ..... A63B 22/0015 482/4
2016/0151665 A1 * 6/2016 Miller ..... A63B 21/4049 482/52
2017/0144016 A1 * 5/2017 Gordon ..... A63B 22/0664

* cited by examiner

ELLIPTICAL EXERCISE DEVICE

REFERENCE TO RELATED APPLICATION

This application claims priority of U.S. Provisional Application Ser. No. 62/477,275, filed Mar. 27, 2017, the entire content of which is incorporated herein by reference.

FIELD OF THE INVENTION

This invention relates generally to elliptical exercise devices in which the path of travel of a user's foot is generally elliptical.

BACKGROUND OF THE INVENTION

There are a number of exercise devices that operate to allow a user to implement a foot action following a generally closed, curved path of travel, simulating running and/or walking. These devices are generally referred to as "elliptical" exercise devices. Many such elliptical exercise devices are large, complicated, costly, and/or have undesirable characteristics related to the motion of the user's feet.

U.S. Pat. No. 5,518,473 to Miller shows an early design for an elliptical exercise device. The device provides a path of travel that simulates running and/or walking but is quite large and does not provide for arm exercise.

U.S. Pat. No. 5,611,756 to Miller discloses an elliptical exercise device with arm and leg movement. A pair of guide links is pivotally supported on a frame and a foot engaging link is supported at the lower end of each guide link. An intermediate link connects each guide link to A crank. A control link joins each foot link to the corresponding intermediate link to vary the angle of the foot link relative to the guide link.

U.S. Pat. No. 6,045,487 to Miller discloses an elliptical exercise device having a pair of guide links pivotally supported on a frame and a foot link supported at the lower end of each guide link. An intermediate link connects each guide link to a crank of a crank system. A flexible pivot axis. The control members connect to a reciprocating assembly for moving the foot links up and down as the guide links pivot back and forth.

U.S. Pat. No. 7,708,668 to Rodgers, Jr. shows several embodiments of an exercise device having flexible elements coupling left and right foot support members to a crank system. The exercise device allows for a variable stride length and decouples the vertical and horizontal components of foot travel.

U.S. Pat. No. 7,556,591 to Chuang et al. discloses an exercise device with cranks mounted to an upper portion of a frame. Two handles are pivoted to the frame forward of the cranks. Foot supports are pivotally coupled to the lower ends of the handles. Pivot rods extend between each foot support and one of the cranks. Additional links connect each handle with the same cranks as the respective pivot rod.

U.S. Pat. No. 8,979,714 to Miller discloses an elliptical exercise device having a frame supporting guide links which provide for horizontal motion of associated foot support links. A mechanical coupling couples the foot support links to the crank system and intermediate links connect the crank system to the guide links such that a foot receiving area of each foot support link moves in an elliptical path when the crank system rotates.

U.S. Pat. No. 9,192,809 to Miller et al. discloses an elliptical exercise device with a frame supporting guide links and foot support links. Upper pulleys are pivotally connected to the frame or guide links, front lower pulleys are connected to the guide links or foot support links and rear lower pulleys are connected to the foot support links. A flexible element extends from a vertical drive assembly to the upper pulley, front lower pulley, rear lower pulley and then to the frame rearward of the guide link pivot.

Additional exercise devices will be known to those of skill in the art.

SUMMARY OF THE INVENTION

The present invention offers several embodiments of an elliptical exercise device. Some embodiments offer a path of motion with desirable characteristics. In addition, some embodiments are compact in form and have reduced mechanical complexity.

A first embodiment of an exercise device has a frame configured to be supported on a horizontal surface, the frame having a first pivot axis defined thereon. A first and a second guide link each have a first and a second attachment point defined thereon, with each guide link being pivotally attached, through its first attachment point, to the frame at the first pivot axis thereof. A first and a second foot support link each have a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion. A first and a second upper pulley are each pivotally connected to the frame. A first and a second lower pulley are each pivotally connected to a respective one of the foot support links below the upper pulleys. A vertical drive assembly is supported on the frame. A first and a second flexible element each have a first end in communication with the vertical drive assembly and a second end connected to the frame rearward of the first pivot axis and near the respective upper pulley. Each flexible element has a midportion extending from the first end, about a respective upper pulley, about a respective lower pulley and to the second end. Each flexible element has a first foot support portion extending between the respective upper pulley and lower pulley and a second foot support portion extending between the respective lower pulley and the second end of the flexible element. The first and second foot support portions of each flexible element are generally parallel to each other and having approximately the same length. The vertical drive assembly is operable via the flexible elements to move the foot receiving areas of the foot support links in a path of travel having a vertical component of motion.

Some versions further include a horizontal drive assembly and a first and a second horizontal drive link each having a first end coupled to the horizontal drive assembly and a second end connected to the respective guide link such that the horizontal drive assembly causes the guide links to pivot about the first pivot axis.

In some versions, a crank system defines the vertical drive assembly and the horizontal drive assembly. The first ends of the flexible elements and of the horizontal drive links are connected to the crank system such that rotation of the crank system causes the foot receiving areas to move both in a path of travel having a horizontal component of motion and in a path of travel having a vertical component of travel. The horizontal component of motion and the vertical component of travel for each foot receiving area are generally out of phase such that the foot receiving areas move in a generally elliptical path.

In some versions, the crank system is disposed forward of and lower than the first pivot axis. Each guide link has an attachment portion extending forwardly from the respective guide link. Each horizontal drive link extends from the crank system generally upwardly to connect to the attachment portion of the respective guide link.

In some versions, each foot support link has a forward end that is pivotally connected to the second attachment point of the respective guide link, a rearward end defining the foot receiving area, and a mid portion, the lower pulleys each being connected the mid portion of the respective foot support link.

In certain versions, each of the upper pulleys is at approximately the same height as the first pivot axis.

In some versions, each flexible element extends upwardly and rearwardly from the first end to the respective upper pulley.

In certain versions, each flexible element engages only the respective upper pulley and lower pulley.

In some versions, each flexible element is a cable, a belt or a chain.

In certain versions, each guide link further includes a hand grip portion extending upwardly from the first attachment point.

A second embodiment of an exercise device has a frame configured to be supported on a horizontal surface, the frame having a first pivot axis defined thereon. A first and a second guide link each have a first and a second attachment point defined thereon. Each guide link is pivotally attached, through its first attachment point, to the frame at the first pivot axis thereof. Each of the guide links has a guide length defined between the first and second attachment point.

A first and a second foot support link each has a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion. A first and a second upper pulley are each pivotally connected to the frame. A first and a second lower pulley are each pivotally connected to a respective one of the foot support links below the upper pulleys. A vertical drive assembly is supported on the frame. A first and a second flexible element each have a first end in communication with the vertical drive assembly and a second end connected to the frame rearward of the first pivot axis and near the respective upper pulley. Each flexible element has a midportion extending from the first end, about a respective upper pulley, about a respective lower pulley and to the second end. Each flexible element has a first foot support portion extending between the respective upper pulley and lower pulley and a second foot support portion extending between the respective lower pulley and the second end of the flexible element. The first foot support portion of each flexible element has a length when the respective foot support link is at a midpoint of vertical travel that is approximately the same as the guide length. The respective first attachment point, second attachment point, lower pulley and upper pulley generally define a parallelogram when the respective foot support link is at the midpoint of vertical travel. The vertical drive assembly is operable via the flexible elements to move the foot receiving areas of the foot support links in a path of travel having a vertical component of motion.

In some versions, the first and second foot support portions of each flexible element are generally parallel to each other and have approximately the same length.

Certain versions further include a horizontal drive assembly and a first and a second horizontal drive link each having a first end coupled to the horizontal drive assembly and a second end connected to the respective guide link such that the horizontal drive assembly causes the guide links to pivot about the first pivot axis.

A crank system may define the vertical drive assembly and the horizontal drive assembly, with the first ends of the flexible elements and of the horizontal drive links being connected to the crank system such that rotation of the crank system causes foot receiving areas to move both in a path of travel having a horizontal component of motion and in a path of travel having a vertical component of travel. The horizontal component of motion and the vertical component of travel for each foot receiving area are generally out of phase such that the foot receiving areas move in a generally elliptical path.

In some versions, the crank system is disposed forward of and lower than the first pivot axis. Each guide link has an attachment portion extending forwardly from the respective guide link, and each horizontal drive link extends from the crank system generally upwardly to connect to the attachment portion of the respective guide link.

In some versions, each foot support link has a forward end that is pivotally connected to the second attachment point of the respective guide link, a rearward end defining the foot receiving area, and a mid portion, the lower pulleys each being connected the mid portion of the respective foot support link.

In certain versions, each of the upper pulleys is at approximately the same height as the first pivot axis.

In some versions, each flexible element extends upwardly and rearwardly from the first end to the respective upper pulley.

In some versions, each flexible element engages only the respective upper pulley and lower pulley.

In certain versions, each flexible element is a cable, a belt or a chain.

In some versions, each guide link further includes a hand grip portion extending upwardly from the first attachment point.

DETAILED DESCRIPTION OF THE PREFERRED EMBODIMENTS

Figure 1:
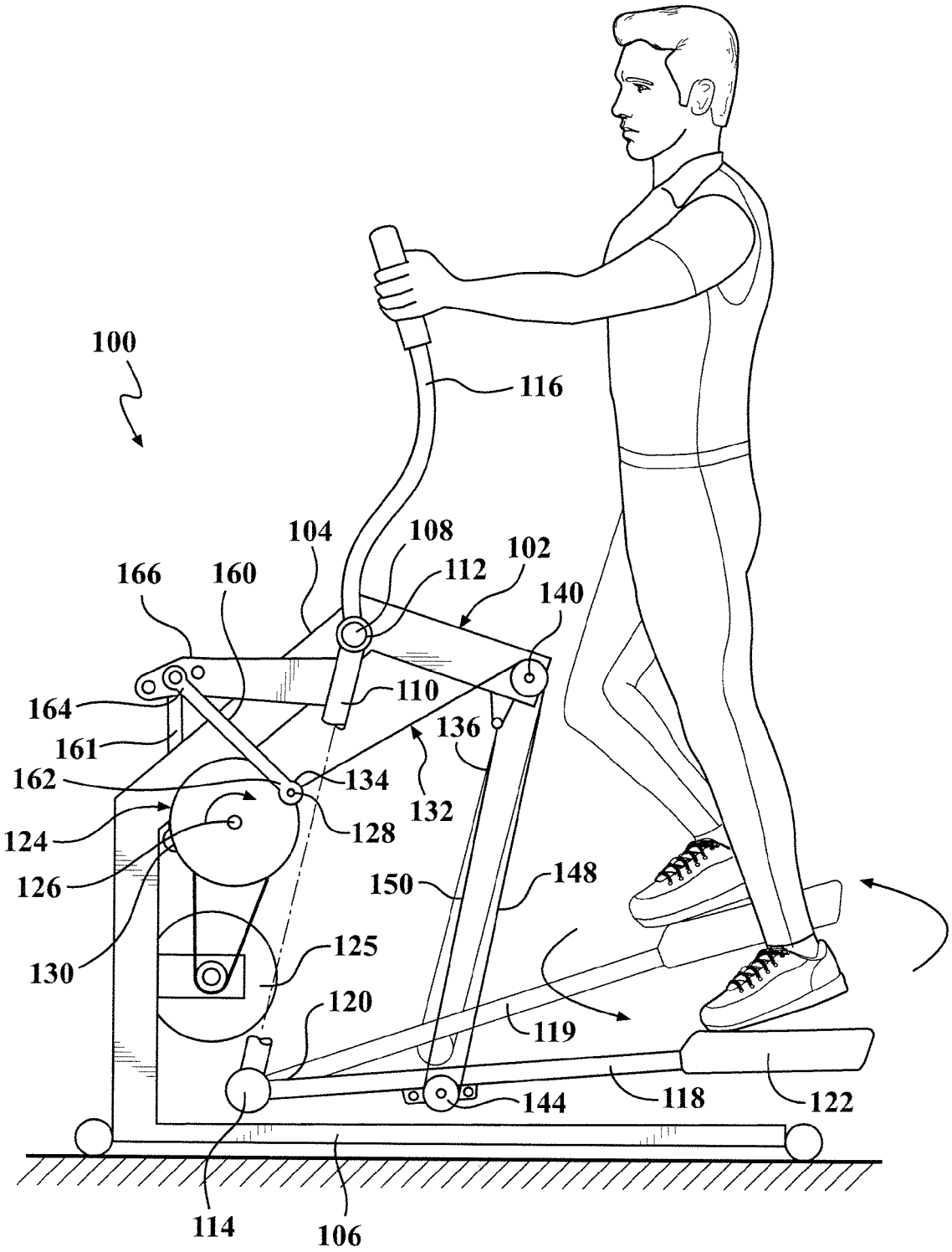
FIG. 1 is a side elevational view of an embodiment of an elliptical exercise device in accordance with the present invention.

The present invention will be explained with reference to a particular embodiment, including optional features of this embodiment. It is to be understood that other embodiments, modifications, and variations thereof will be apparent to those of skill in the art in view of the teaching presented herein.

The present invention relates to exercise devices which are often referred to as elliptical exercise devices. An elliptical exercise device is designed to be used by a user placing their feet on respective foot receiving areas and then moving their feet along a generally elliptical path. This path will have horizontal and vertical components. The term "elliptical exercise device" is used herein in its broad sense to include both free stride exercise devices and fixed path exercise devices.

In a free stride exercise device, the motion of the foot receiving areas along a path of travel having a horizontal component of motion is generally decoupled from motion of the foot receiving areas along a path of travel having a vertical component of motion. Typically, a free stride exercise device will allow a user to alter the length of the horizontal path of travel by exerting more or less fore-aft force to the foot receiving areas or associated hand grip areas. Typically, such a device will have a coordination linkage that coordinates the horizontal travel such that as one foot receiving area moves rearwardly, the other foot receiving area moves forwardly by an equal amount. Typically, a resistance element is also provided to provide resistance to the horizontal motion, though this is not mandatory. In a free stride device, the vertical motion is typically controlled by some type of vertical drive system that is coupled to the foot receiving areas and causes the foot receiving areas to oscillate upwardly and downwardly by a predetermined amount. The height of the vertical travel may or may not be adjustable. In some free stride devices, the path of travel may be adjusted so as to be primarily horizontal so as to mimic a striding or cross-country skiing motion, primarily vertical so as to mimic a climbing motion, or a combination of horizontal and vertical such that the foot receiving areas travel along a curved generally elliptical path. The term "generally elliptical" is intended to mean any curved path and is not limited to a strictly mathematical ellipse.

A fixed path elliptical exercise device is one in which the foot receiving areas travel along a path that is determined by the device rather than by the amount of force applied by the user. The amount of horizontal or vertical travel may be non-adjustable such that the foot receiving areas travel through a single predetermined path. Alternatively, the horizontal or the vertical travel, or both, may be adjustable so as to change the length, height, and/or shape of the elliptical path. In some embodiments, the present invention may also be useful as a stepper or striding type exercise device that may not typically be considered an elliptical exercise device.

Embodiments of the present invention make use of a crank system to control the horizontal and/or vertical motions of the foot receiving areas of the exercise device.

FIG. 1 is a side view showing the basic layout of a fixed-path version of an elliptical exercise device 100. The illustrated device 100 includes a frame 120 which is configured and operative to contain and/or support the various other components of the device on a horizontal surface such as a floor. The frame 102 may take a variety of the shapes and forms, as long as it provides support for the components of the device. The frame 102 has an upper portion 104 and a lower portion 106. The lower portion 106 is configured to contact the horizontal surface while the upper portion 104 supports several components of the device. A first pivot axis 108 is defined in a middle area of the upper portion 104 of the frame 102. The frame 102 may be said to have a forward portion forward of the first pivot axis 108, which is to the left in the view of FIG. 1, and a rearward portion rearward of the first pivot axis 108, which is to the right in the view of FIG. 1. As will be clear to those of skill in the art, exercise devices such as those described herein include left and right elements for supporting the respective left and right feet of the user. The right and left components of the device are typically substantially the same, though the machine may be constructed such that the two foot receiving areas are 180 degrees out of phase. That is, when one foot receiving area is moving forwardly and/or downwardly, the other foot receiving area is moving rearwardly and/or upwardly. The embodiments of the present invention will be described primarily with reference to only one set of components, with it being understood that the corresponding components of the other half of the device are constructed similarly. FIG. 1 shows a side view of the device 100 with the left elements most visible.

A pair of guide links are pivotally interconnected with the frame so as to be pivotable about the first pivot axis 108. The left guide link 110 is shown at the midpoint of its travel with the right guide link hidden behind it. The guide link 110 is partially cut away in the FIG. 10 to make other components more visible. All left and right components may alternatively be referred to as first and second components for ease of description. The guide link 110 may be said to have a first attachment point 112 towards its upper end and a second attachment point 114 at its lower end. The guide link 110 is pivotally interconnected with the first pivot axis 108 of the frame 102 at its first attachment point 112. In the illustrated embodiment, the guide link 110 further includes a hand portion 116 that extends upwardly from the first attachment point 112. Each guide link 110 has a corresponding foot support link 118 pivotally connected thereto. In the illustrated embodiment, the foot support link 118 has a forward end 120 that is pivotally interconnected with the second attachment point 114 of the guide link 110. The foot support link 118 further has a foot receiving area 122 defined at its rearward end. A crank system 124 is pivotally interconnected with the frame 102 such that a crank system 124 rotates about a second pivot axis 126 defined on the frame 102. The second pivot axis 126 also serves as the crank axis. In this embodiment, the crank system 124 is forward of the first pivot axis 108 and the second pivot axis 126 is below the first pivot axis 108, though it may be positioned elsewhere in other embodiments. The crank system 124 has a pair of crank connections or arms 128 and 130 that are 180 degrees apart. In the illustrated embodiment, the crank "arms" are defined by a pulley having connection locations defined thereon. In alternative embodiments, the crank may have actual arms extending from the crank axis. The crank system 124 represents one type of drive assembly, which in this case is a combined vertical and horizontal drive assembly. The crank system may include a flywheel such as shown at 125 and any type of resistance device. In the illustrated embodiment, element 125 may also represent a resistance device for resisting rotation of the crank system 124.

A flexible element 132 couples the crank arm 128 to the respective foot support link 118 such that rotation of the crank system 124 causes the foot receiving area 122 of the foot support link 118 to move upwardly and downwardly, which is a path of travel having a vertical component of motion. The flexible element 132 may be a cable, belt, chain, or another type of flexible element. One end 134 of the element 132 is connected to crank arm 128 and an opposite end 136 is connected to the upper part 104 of the frame 102 rearward of the first pivot axis 108. As shown, the second end 136 of the flexible element is attached to the frame near the pulley 140. As used herein, the term "near" means that the frame connection 136 is generally in the same area of the frame as the pulley 140 but they do not have to be directly adjacent. The end 136 also defines a frame attachment point 136. A midportion of the flexible element 132 passes over various pulleys such that as the crank system 124 rotates, the foot receiving areas are moved upwardly and downwardly.

An upper pulley 140 is pivotally mounted to the upper part 104 of the frame 102 rearward of the first pivot axis 108. A lower pulley 144 is pivotally connected to the foot support link 118 at a pulley location between the front end 120 and foot receiving area 122. As shown, the lower pulley 144 is below the upper pulley 140. The pulley location may be considered to be in a mid portion of the foot support link 118.

As shown, the flexible element 132 extends from the first end 134 over the upper pulley 140, down to and around the lower pulley 144, and back up to the second end and frame attachment point 136. The flexible element may be said to have a first foot support portion 148 extending between the upper pulley 140 and lower pulley 144 and a second foot support portion 150 extending between the lower pulley 144 and the frame attachment 136. In the illustrated embodiment, the frame attachment point is located close to the pivot axis of the upper pulley 140 such that the first and second foot support portions of the flexible element 132 are generally parallel to each other and have approximately the same length. As used herein, "generally parallel" shall mean that two elements are within 25 degrees of each other and "approximately the same length" shall mean that the two elements have a length within 25% of each other. In some embodiments, generally parallel elements may be within 10 degrees of each other. In certain embodiments, elements with approximately the same length may have a length within 10% of each other.

The illustrated configuration provides a parallelogram-type configuration. The pulleys 140 and 144 are positioned, relative to the first pivot axis 108 and the second attachment point 114 on the guide link 110, such that the foot support portions 148 and 150 of the flexible element are generally parallel to the respective guide link 110 at all times. Further, the guide link 110 may be said to have a guide length defined between the first attachment point 112 and second attachment point 114. The length of the foot support portion 148 and 150 of the flexible element 132 varies with the position of the foot support link 118. In FIG. 1, the foot support link 118 is shown in a lower position. The right foot support link 119 is shown in an upper position. As will be clear from the figure, the length of the foot support portion 152 of the flexible element 132 when the foot support link is at any point of its vertical travel is approximately the same as the guide length of the guide link 110. In this particular embodiment, the lengths are closest with the respective foot support link at its lowest position. As such, the first attachment point 112, second attachment point 114, lower pulley 144, and upper pulley 136 generally define a parallelogram when the foot support link 118 is at a midpoint of its vertical travel. This parallelogram-type configuration provides a desirable motion profile. Alternatively, the first foot support portion 148 may be parallel to the guide link 110 without the lengths matching.

As shown, the exercise device has only 2 pulleys, 140 and 144, per side, left or right, for controlling vertical motion. The flexible elements engage only these pulleys.

The provision of a pulley on the foot support link and the first and second foot support portions of the flexible element provide a block-and-tackle type arrangement wherein the travel of the foot support portion is only about half what it would be if the flexible element merely had one portion extending between the frame and foot support portion. This may reduce the forces in the flexible element, provide smoother motion, and/or provide a better feel to the motion. It is noted that the term "pulley", as used herein, is intended to encompass traditional pulleys as well as other elements that provide appropriate guiding of the flexible element. The use of the block-and-tackle approach allows the flexible element to be farther forward than for the same level of load. For example, in the illustrated embodiment, the lower pulley is closer to the front attachment 114 than to the foot receiving area 122. To have the same level of load in the flexible element without the block-and-tackle approach would require moving the lower pulley, and probably the upper pulley, towards the rear end of the foot support link 118. This may put the flexible link in an inconvenient location, very close to the user's feet, and require a more substantial frame structure to support an upper pulley farther to the rear. In certain embodiments, the lower pulley is located in the forward 60% of the foot support link and in certain other embodiments the lower pulley is located in the forward 50% of the foot support link.

The illustrated embodiment of the exercise device 100 is fixed path device with a horizontal drive assembly driving the guide links such that the foot receiving areas move in a path of travel having a horizontal component of motion. In this embodiment, the horizontal drive assembly is part of the crank system 124. Specifically, the crank system is also a crank for the horizontal drive. A horizontal drive link 160 has a lower 162 end connected to the crank system 124 and an upper end 164 connected to an attachment portion 166 extending forwardly from the guide link 110. As such, as the crank system 124 rotates about the crank axis 126, the horizontal drive link 160 causes the guide link 110 to pivot about the first pivot axis 108. A second horizontal drive link 161 controls the other guide link and is attached to the crank at a position 180 degrees from the first horizontal drive link 160. As shown, in this embodiment, the connection of the horizontal drive links 160 and 161 are the same as the connection of the respective flexible element (only element 132 is shown). That is, the horizontal drive link 160 for controlling horizontal motion of the left foot is connected to the crank at the same location as the flexible element 132 for controlling vertical motion of the left foot.

In some embodiments, the connection locations may be different so as to provide a desirable footpath.

To adjust the range of horizontal travel, the attachment points on attachment portion 166 may be adjustable, either manually or by an actuator so as to change where the horizontal drive link 160 attaches. Likewise, the range of vertical travel may be adjusted by changing the position of the lower pulley 144 on the foot support link 118, either manually or by an actuator. Various attachment points are shown as an example of an adjustment option. Other options may be used.

The present invention may also provide a free stride elliptical exercise device. In this version, the horizontal drive links 160 and 161 are omitted and the guide links may be interconnected by a coordination mechanism that maintains them at 180 degrees out of phase. Those of skill in the art will be aware of coordination mechanisms for use with such an exercise device.

Figure 2:
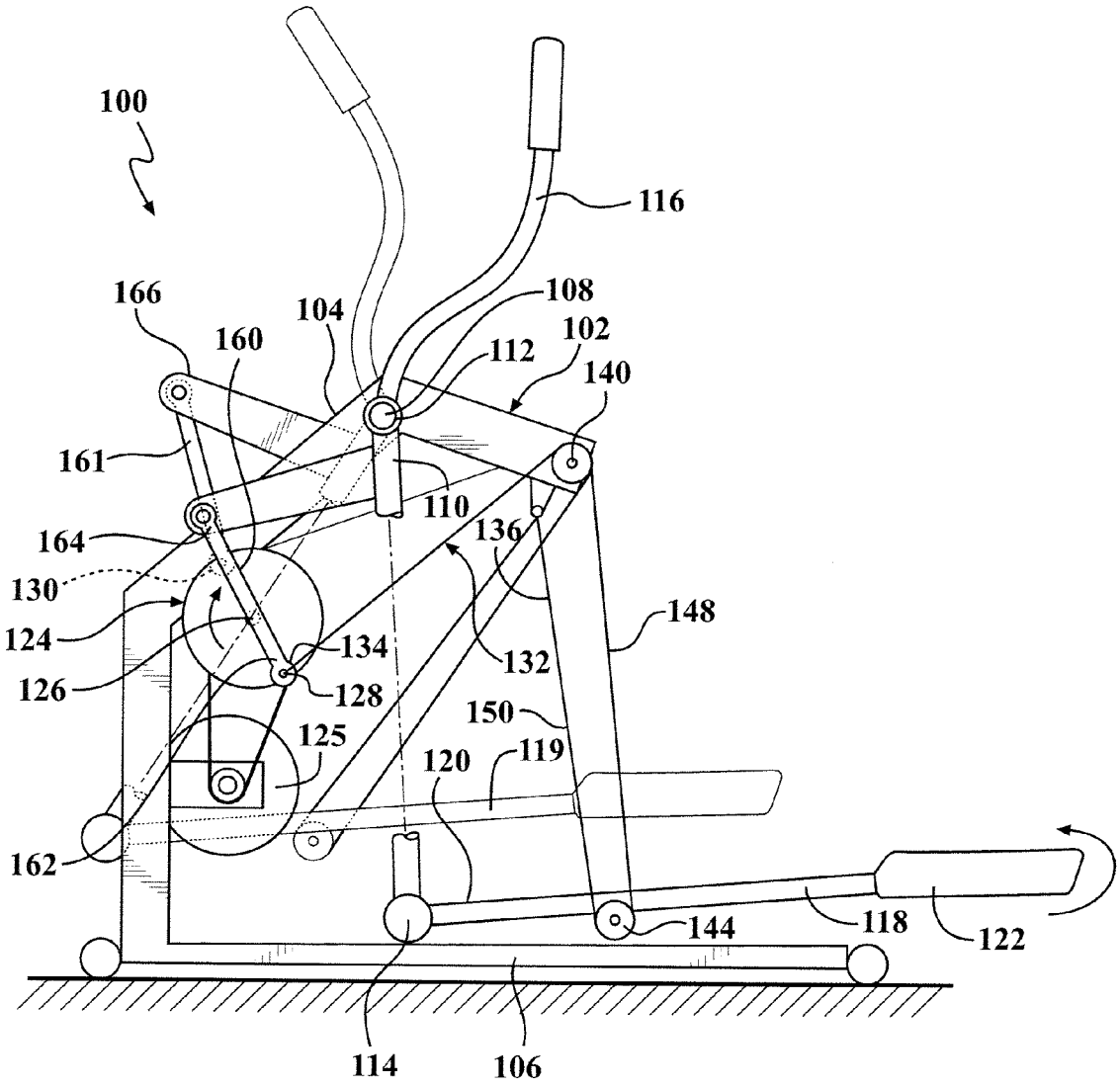
FIG. 2 is a side elevational view of the elliptical exercise device of FIG. 1 with the crank in a different position.

FIG. 2 shows the exercise device with the crank pivoted by 90 degrees, with the foot receiving areas at their respective rearwardmost and forwardmost positions.

Further alternatives, which do not depart from the scope or teaching of the present invention, will be clear to those of skill in the art. It is the following claims, including all equivalents, which define the scope of the present invention.

The invention claimed is:

1. An exercise device comprising:

a frame configured to be supported on a horizontal surface, the frame having a first pivot axis defined thereon;

a first and a second guide link each having a first and a second attachment point defined thereon, each guide link being pivotally attached, through its first attachment point, to the frame at the first pivot axis thereof;

a first and a second foot support link each having a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion;

a first and a second upper pulley each pivotally connected to the frame;

a first and a second lower pulley each pivotally connected to a respective one of the foot support links below the upper pulleys;

a vertical drive assembly supported on the frame, the vertical drive assembly comprising a crank system, the crank system having a crank axis and a pair of crank connections offset from and rotatable about the crank axis;

a first and a second flexible element each having a first end connected to one of the crank connections of the crank system such that the first end travels in a circular path, each flexible element further having a second end connected to the frame rearward of the first pivot axis and near the respective upper pulley, each flexible element having a midportion extending from the first end, about a respective upper pulley, about a respective lower pulley and to the second end;

the midportion of each flexible element having a first foot support portion extending between the respective upper pulley and lower pulley and a second foot support portion extending between the respective lower pulley and the second end of the flexible element, the first and second foot support portions of each flexible element being generally parallel to each other and having approximately a same length;

wherein the vertical drive assembly is operable via the flexible elements to move the foot receiving areas of the foot support links in a path of travel having a vertical component of motion.

2. The exercise device in accordance with claim 1, further comprising:

a horizontal drive assembly;

a first and a second horizontal drive link each having a first end coupled to the horizontal drive assembly and a second end connected to the respective guide link such that the horizontal drive assembly causes the guide links to pivot about the first pivot axis.

3. The exercise device in accordance with claim 2, wherein a range of the vertical component of motion and/or the horizontal component of motion is adjustable.

4. The exercise device in accordance with claim 2, wherein the crank system defines both the vertical drive assembly and the horizontal drive assembly, the horizontal drive links being connected to the crank system such that rotation of the crank system causes the foot receiving areas to move both in the path of travel having the horizontal component of motion and in the path of travel having the vertical component of motion, the horizontal component of motion and the vertical component of motion for each foot receiving area being generally out of phase such that the foot receiving areas move in a generally elliptical path.

5. The exercise device in accordance with claim 4, wherein the crank system is disposed forward of and lower than the first pivot axis, each guide link having an attachment portion extending forwardly from the respective guide link, each horizontal drive link extending from the crank system generally upwardly to connect to the attachment portion of the respective guide link.

6. The exercise device in accordance with claim 1, wherein each foot support link has a forward end that is pivotally connected to the second attachment point of the respective guide link, a rearward end defining the foot receiving area, and a mid portion, the lower pulleys each being connected to the mid portion of the respective foot support link.

7. The exercise device in accordance with claim 6, wherein each lower pulley is connected to a forward 60% of the respective foot support link.

8. The exercise device in accordance with claim 1, wherein each of the upper pulleys is at approximately a same height as the first pivot axis.

9. The exercise device in accordance with claim 1, wherein each flexible element extends upwardly and rearwardly from the first end to the respective upper pulley.

10. The exercise device in accordance with claim 1, wherein each flexible element extends linearly directly from the respective upper pulley to the respective crank connection.

11. The exercise device in accordance with claim 1, wherein each flexible element is a cable, a belt or a chain.

12. The exercise device in accordance with claim 1, wherein each guide link further includes a hand grip portion extending upwardly from the first attachment point.

13. An exercise device comprising:

a frame configured to be supported on a horizontal surface, the frame having a first pivot axis defined thereon;

a first and a second guide link each having a first and a second attachment point defined thereon, each guide link being pivotally attached, through its first attachment point, to the frame at the first pivot axis thereof, each of the guide links having a guide length defined between the first and second attachment point;

a first and a second foot support link each having a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion;

a first and a second upper pulley each pivotally connected to the frame;

a first and a second lower pulley each pivotally connected to a respective one of the foot support links below the upper pulleys;

a vertical drive assembly supported on the frame, the vertical drive assembly comprising a crank system, the crank system having a crank axis and a pair of crank connections offset from and rotatable about the crank axis;

a first and a second flexible element each having a first end connected to one of the crank connections of the crank system such that the first end travels in a circular path, each flexible element further having a second end connected to the frame rearward of the first pivot axis and near the respective upper pulley, each flexible element having a midportion extending from the first end, about a respective upper pulley, about a respective lower pulley and to the second end;

the midportion of each flexible element having a first foot support portion extending between the respective upper pulley and lower pulley and a second foot support portion extending between the respective lower pulley and the second end of the flexible element;

the first foot support portion of each flexible element having a length when the respective foot support link is at a midpoint of vertical travel that is approximately the same as the guide length;

wherein the respective first attachment point, second attachment point, lower pulley and upper pulley generally define a parallelogram when the respective foot support link is at the midpoint of vertical travel; and wherein the vertical drive assembly is operable via the flexible elements to move the foot receiving areas of the foot support links in a path of travel having a vertical component of motion.

14. The exercise device in accordance with claim 13, wherein the first and second foot support portions of each flexible element are generally parallel to each other and have approximately a same length.

15. The exercise device in accordance with claim 13, further comprising:

a horizontal drive assembly;

a first and a second horizontal drive link each having a first end coupled to the horizontal drive assembly and a second end connected to the respective guide link such that the horizontal drive assembly causes the guide links to pivot about the first pivot axis.

16. The exercise device in accordance with claim 15, wherein a range of the vertical component of motion and/or the horizontal component of motion is adjustable.

17. The exercise device in accordance with claim 15, wherein the crank system defines both the vertical drive assembly and the horizontal drive assembly, the horizontal drive links being connected to the crank system such that rotation of the crank system causes the foot receiving areas to move both in the path of travel having the horizontal component of motion and in the path of travel having the vertical component of motion, the horizontal component of motion and the vertical component of motion for each foot receiving area being generally out of phase such that the foot receiving areas move in a generally elliptical path.

18. The exercise device in accordance with claim 17, wherein the crank system is disposed forward of and lower than the first pivot axis, each guide link having an attachment portion extending forwardly from the respective guide link, each horizontal drive link extending from the crank system generally upwardly to connect to the attachment portion of the respective guide link.

19. The exercise device in accordance with claim 13, wherein each foot support link has a forward end that is pivotally connected to the second attachment point of the respective guide link, a rearward end defining the foot receiving area, and a mid portion, the lower pulleys each being connected to the mid portion of the respective foot support link.

20. The exercise device in accordance with claim 19, wherein each lower pulley is connected to a forward 60% of the respective foot support link.

21. The exercise device in accordance with claim 13, wherein each of the upper pulleys is at approximately a same height as the first pivot axis.

22. The exercise device in accordance with claim 13, wherein each flexible element extends upwardly and rearwardly from the first end to the respective upper pulley.

23. The exercise device in accordance with claim 13, wherein each flexible element extends linearly directly from the respective upper pulley to the respective crank connection.

24. The exercise device in accordance with claim 13, wherein each flexible element is a cable, a belt or a chain.

25. The exercise device in accordance with claim 13, wherein each guide link further includes a hand grip portion extending upwardly from the first attachment point.

26. An exercise device comprising:

a frame configured to be supported on a horizontal surface, the frame having a first pivot axis defined thereon;

a first and a second guide link each having a first and a second attachment point defined thereon, each guide link being pivotally attached, through its first attachment point, to the frame at the first pivot axis thereof;

a first and a second foot support link each having a foot receiving area to support a user's foot thereupon, each foot support link being pivotally connected to the second attachment point of a respective one of the guide links so that when the guide links pivot relative to the frame, the guide links each cause the foot receiving area of the respective foot support link to move in a path of travel having a horizontal component of motion;

a first and a second upper pulley each pivotally connected to the frame;

a first and a second lower pulley each pivotally connected to a respective one of the foot support links below the upper pulleys;

a vertical drive assembly supported on the frame;

a first and a second flexible element each having a first end connected to the vertical drive assembly and a second end connected to the frame rearward of the first pivot axis and near the respective upper pulley, each flexible element having a midportion extending from the first end, about a respective upper pulley, about a respective lower pulley and to the second end;

the midportion of each flexible element having a first foot support portion extending between the respective upper pulley and lower pulley and a second foot support portion extending between the respective lower pulley and the second end of the flexible element, the first and second foot support portions of each flexible element being generally parallel to each other and having approximately a same length;

each flexible element extending linearly from the respective upper pulley to the respective first end of the vertical drive assembly;

wherein the vertical drive assembly is operable via the flexible elements to move the foot receiving areas of the foot support links in a path of travel having a vertical component of motion.

27. The exercise device in accordance with claim 26, further comprising:

a horizontal drive assembly;

a first and a second horizontal drive link each having a first end coupled to the horizontal drive assembly and a second end connected to the respective guide link such that the horizontal drive assembly causes the guide links to pivot about the first pivot axis.

28. The exercise device in accordance with claim 27, wherein a crank system defines both the vertical drive assembly and the horizontal drive assembly, the horizontal drive links being connected to the crank system such that rotation of the crank system causes the foot receiving areas to move both in the path of travel having the horizontal component of motion and in the path of travel having the vertical component of motion, the horizontal component of motion and the vertical component of motion for each foot receiving area being generally out of phase such that the foot receiving areas move in a generally elliptical path.

29. The exercise device in accordance with claim 28, wherein the crank system is disposed forward of and lower than the first pivot axis, each guide link having an attachment portion extending forwardly from the respective guide link, each horizontal drive link extending from the crank system generally upwardly to connect to the attachment portion of the respective guide link.

30. The exercise device in accordance with claim 26, wherein each guide link further includes a hand grip portion extending upwardly from the first attachment point.

* * * * *